US011591873B2

(12) United States Patent
Milne

(10) Patent No.: US 11,591,873 B2
(45) Date of Patent: Feb. 28, 2023

(54) HIGH-EXPANSION WELL SEALING USING SEAL SEAT EXTENDER

(71) Applicant: Halliburton Energy Services, Inc., Houston, TX (US)

(72) Inventor: Adam J. Milne, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/384,321

(22) Filed: Jul. 23, 2021

(65) Prior Publication Data

US 2023/0026973 A1 Jan. 26, 2023

(51) Int. Cl.
*E21B 23/06* (2006.01)
*E21B 33/12* (2006.01)
*E21B 33/128* (2006.01)

(52) U.S. Cl.
CPC ..... *E21B 23/06* (2013.01); *E21B 33/12* (2013.01); *E21B 33/128* (2013.01)

(58) Field of Classification Search
CPC ..... E21B 23/06; E21B 33/12
See application file for complete search history.

(56) References Cited

U.S. PATENT DOCUMENTS

| | | | | |
|---|---|---|---|---|
| 9,835,003 | B2 * | 12/2017 | Harris | E21B 23/01 |
| 10,533,392 | B2 * | 1/2020 | Walton | E21B 33/134 |
| 10,563,476 | B2 * | 2/2020 | Smith | E21B 34/063 |
| 10,711,560 | B2 * | 7/2020 | Schmidt | E21B 33/1208 |
| 10,724,311 | B2 * | 7/2020 | Parekh | E21B 33/1295 |
| 10,934,805 | B2 * | 3/2021 | Li | E21B 33/1291 |
| 2013/0269956 | A1 * | 10/2013 | Yee | E21B 43/108 166/387 |
| 2015/0013964 | A1 * | 1/2015 | Xu | E21B 33/134 166/305.1 |
| 2017/0204700 | A1 * | 7/2017 | Hughes | E21B 43/14 |
| 2018/0051532 | A1 * | 2/2018 | Smith | E21B 33/134 |
| 2019/0234177 | A1 * | 8/2019 | Silva | E21B 17/042 |
| 2019/0292874 | A1 * | 9/2019 | Saeed | E21B 33/1293 |
| 2019/0352998 | A1 * | 11/2019 | Wolf | E21B 33/128 |
| 2020/0355040 | A1 * | 11/2020 | Li | E21B 33/134 |
| 2021/0032955 | A1 * | 2/2021 | Zakharia | E21B 33/127 |
| 2021/0054704 | A1 * | 2/2021 | Merron | E21B 33/124 |
| 2021/0054714 | A1 * | 2/2021 | Nichols | E21B 33/1285 |
| 2021/0123320 | A1 * | 4/2021 | Norman | E21B 34/14 |
| 2022/0034192 | A1 * | 2/2022 | Harris | E21B 23/06 |

FOREIGN PATENT DOCUMENTS

| | | |
|---|---|---|
| CA | 2731511 | 8/2011 |

* cited by examiner

*Primary Examiner* — Steven A MacDonald
(74) *Attorney, Agent, or Firm* — Scott Richardson; C. Tumey Law Group PLLC

(57) ABSTRACT

A sealing tool, system and method for sealing a wellbore achieves increased expansion with the use of a seal seat extender. In one example, a seal seat (e.g., a ball seat) defines an axial flow bore in fluid communication with the wellbore to be sealed, a sealing profile for receiving a loose sealing element (e.g., a ball or dart) to close the axial flow bore, and a tapered outer profile. The seal seat extender is initially disposed against the seal seat and is expandable against the seal seat in response to an axial setting force, such as by sliding up the tapered outer profile of the seal seat and/or buckling outwardly, in response to a setting force. A compliant annular packing element disposed against the seal seat extender is deformable outwardly into sealing engagement with the wellbore in response to the axial setting force.

18 Claims, 6 Drawing Sheets

HIGH-EXPANSION WELL SEALING USING SEAL SEAT EXTENDER

BACKGROUND

Wellbores are drilled into the earth for a variety of purposes including accessing hydrocarbon bearing formations. A variety of downhole tools may be used within a wellbore in connection with accessing and extracting such hydrocarbons. Throughout the process, it may become necessary to isolate sections of the wellbore in order to create pressure zones. Downhole tools, such as hydraulic fracturing ("frac") plugs, bridge plugs, packers, and other suitable tools, may be used to isolate wellbore sections.

Downhole tools, such as frac plugs, are commonly run into the wellbore on a conveyance such as a wireline, work string or production tubing. Such tools typically have either an internal or external setting tool, which is used to set the downhole tool within the wellbore and hold the tool in place. Once in place, the downhole tools allow fluid communication between sections of the wellbore above the plug and below the plug until another downhole tool, such as a ball, is pumped down to seat in the plug and interrupt fluid communication through the plug, and a sealing assembly, which can be made of rubber and extends outwards to seal off the flow of liquid around the downhole tool.

BRIEF DESCRIPTION OF THE DRAWINGS

These drawings illustrate certain aspects of some of the embodiments of the present disclosure and should not be used to limit or define the method.

DETAILED DESCRIPTION

A high-expansion well sealing tool is disclosed having a seal seat for receiving a loose sealing element, such as a ball or dart, a tapered outer profile to facilitate expansion of an annular packing element, and a seal seat extender between the seal seat and annular expansion element to increase the expansion. Although the opportunity for increased expansion is generally desirable in a broad range of sealing applications, there are some cases in which increased expansion may be especially important. For example, those skilled in the art will appreciate that in the case of a re-frac, compromised casing, and/or casing patches, having a high-expansion frac plug may allow operations to continue after standard frac plug operations are no longer viable. For single slip frac plugs, squeeze in the packer element created by the ball seat OD is critical to allow the plug to stay set and to seal against frac pressures.

In one or more example configurations, the seal seat may define an axial flow bore in fluid communication with the wellbore to be sealed. The seal seat defines a sealing profile for receiving the loose sealing element (e.g., ball or dart) after setting the well tool, to close an axial flow bore of the well tool prior to performing a service operation. The seal seat extender may be disposed between the seal seat and an annular packing element. The annular packing element may comprise a compliant member formed of an elastically deformable material, such as a rubber or elastomeric material, that may substantially fill a volume defined by rigid adjacent well tool components. The seal seat extender is, by comparison, a rigid element, that is expandable adjacent the seal seat via expansion slots or separate sections, in response to a large setting force. In some examples, the seal seat extender is expanded in response to sliding along a tapered outer profile of the seal seat. In other examples, the seal seat extender is expandable by buckling outwardly from the seal seat in response to the setting force. In either case, the expansion of the seal seat extender may effectively increase the diameter of the seal seat and/or reduce the available volume for the packing element to expand into, either or both of which may increase the amount of expansion and/or sealing force between the packing element and the wellbore.

Without limitation, some examples of a high-expansion well sealing tool according to this disclosure may allow for a diametrical difference between plug outer diameter and casing inner diameter (e.g., greater than 0.50 inch or ~13 mm). A conventional ball seat might otherwise be unable to create enough squeeze on its own. The disclosed seal seat extender increases the amount of squeeze in the high expansion application while also maintaining run-in-hole (RIH) OD drift requirements.

Figure 1:
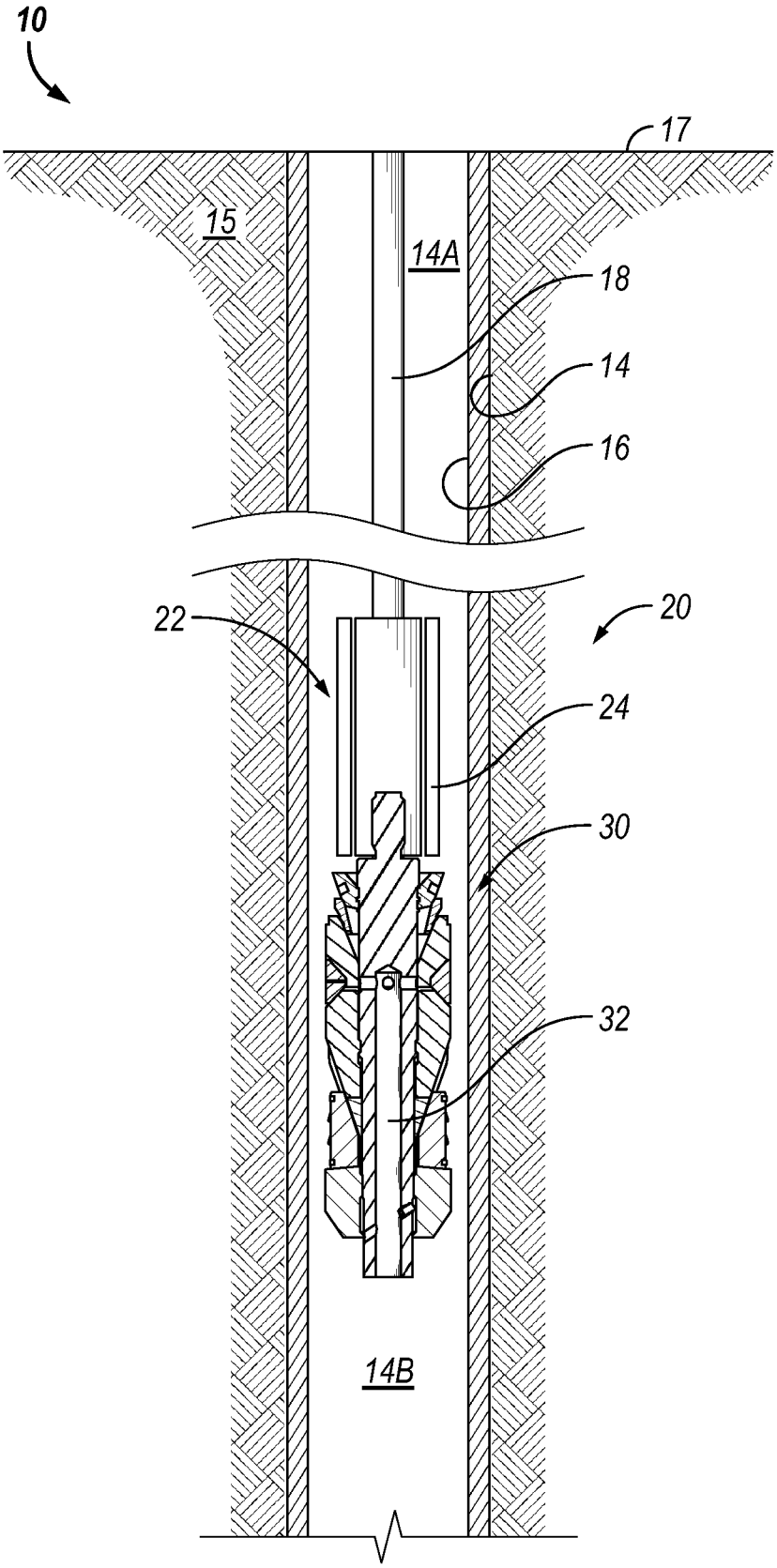
FIG. 1 is an elevation view of a well site in which a wellbore sealing system according to an example of the present disclosure may be implemented.

FIG. 1 (not to scale) is an elevation view of a well site 10 in which a wellbore sealing system 20 according to an example of the present disclosure may be implemented. Although FIG. 1 depicts a land-based well site 10, those skilled in the art will also appreciate that aspects of this disclosure may be applied to other well sites including offshore, fixed or floating platform, subsea, and/or other kinds of well operations. A representative wellbore 14 is shown, having been drilled through one or more stratigraphic layers of the earth 15. FIG. 1 shows a straight, vertical portion of the wellbore 14, but it will be understood that directional drilling techniques may be implemented, such as using a rotary steerable system providing directional control to deviate from vertical and achieve any desired wellbore path. A tubular, typically metallic casing 16 is cemented in place to reinforce the wellbore 14. For purposes of this disclosure, the inner surface of the casing 16, when present, may functionally define an inner surface of the wellbore where casing is present. The wellbore sealing system 20 is typically used to seal off the wellbore 14 by sealing against the inner diameter (ID) of the casing 16.

The wellbore sealing system 20 includes a well tool 30, shown in FIG. 1 in a run-in-hole (RIH) condition prior to being set by a setting tool schematically shown at 22. The well tool 30 is run into the wellbore 14 on a conveyance, which in this example includes a tubing string 18, but could alternatively include a coiled tubing, wireline, or other conveyance. The tubing string 18 may extends to a wellhead at the ground level (aka "surface") 17 of the well site, for conducting produced fluids from the hydrocarbon bearing formation to the surface. The mandrel 32 may be connected to the tubing string 18, and the components of the well tool are at least initially supported on the mandrel 32 when tripped into the wellbore 14. The setting tool 22 includes an actuatable element, such as a sleeve 24, for applying a large axial setting force (e.g., hydraulically) to set the well tool 30 at a desired location within the wellbore 14. Setting the well tool 30 squeezes the components of the well tool 30 together axially, which may both anchor the well tool 30 in the casing 16 and seal against the casing 16. For instance, the well tool 30 may be set in the axial position shown to sealingly isolate an uphole portion 14A of the wellbore 14 from a downhole portion 14B of the wellbore 14. In some examples, the well tool 30 may be a hydraulic fracturing plug (i.e., frac plug) used to plug the wellbore 14 prior to performing a hydraulic fracturing operation in the uphole portion 14A. The various configurations discussed below may allow the well tool 30 to be set within a larger diameter and/or within a larger range of diameters than might ordinarily be practicable for a conventional tool.

Figure 2:
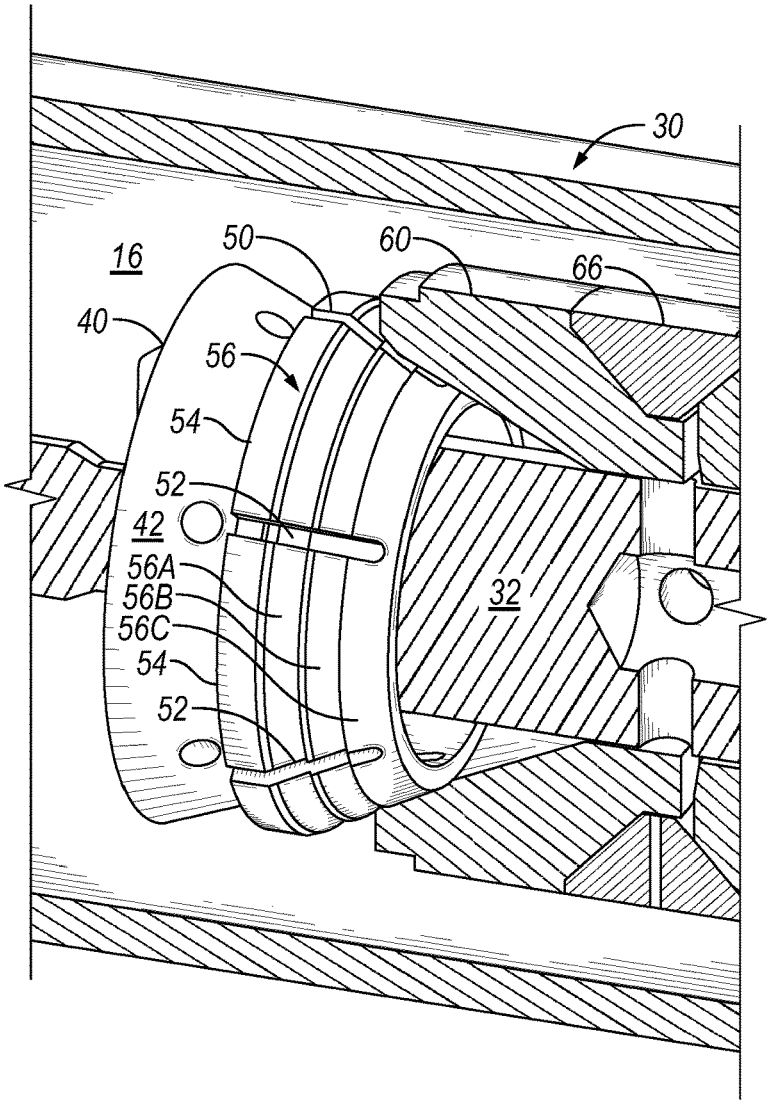
FIG. 2 is a perspective view of the well tool according to one example configuration.

FIG. 2 is a perspective view of the well tool 30 according to one example configuration. The well tool 30 is disposed in the casing 16, which defines an inner surface of the wellbore to be sealed. The well tool is shown in the RIH condition, with an example arrangement of a seal seat 40, seal seat extender 50, and compliant annular packing element 60 axially arranged on a mandrel 32. Generally, the seal seat 40, seal seat extender 50, and annular packing element 60 will be squeezed together axially with a setting tool to deform the annular packing element 60 outwardly along the seal seat extender 50 into engagement with the casing 16.

The seal seat 40 includes a tapered outer profile 42, which more particularly has a generally frustoconical shape in this example. The seal seat extender 50 is between the seal seat 40 and the packing element 60. The seal seat extender 50 is expandable radially outwardly along the tapered outer profile 42 of the seal seat 40 when the well tool 30 is set. In this example, the seal seat extender 50 is a unitary structure that includes expansion slots 52 between circumferentially spaced, structurally-interconnected sections 54 along its periphery, to facilitate this expansion. In another embodiment, the circumferentially spaced sections 54 could be structurally separate (i.e., not directly secured to one another) so the sections 54 may spread outwardly from one another when the well tool 30 is set.

The seal seat extender 50 also includes a tapered outer profile, which may comprise a generally frustoconical profile generally indicated at 56. In this example, the generally frustoconical profile 56 of the seal seat extender 50 comprises a plurality of frustoconical sections 56A, 56B, 56C discussed further below. The packing element 60 will ride up the tapered outer profile 56 during setting to urge the packing element 60 into sealing engagement with the casing 16. The seal seat extender 50 thereby increases the radial expansion of the packing element 60 as compared with having the packing element 60 ride directly along the tapered outer profile 42 of the seal seat 40 without the seal seat extender 50.

An extension limiter 66 is provide on the other end of the packing element 60. The extension limiter 66 may comprise, for example, a short helical section so it may expand with the annular packing element 60 into engagement with the casing 16 during setting. The extension limiter 66 may also contain the volume into which the packing element may expand and help prevent extrusion of the packing element.

Figure 3:
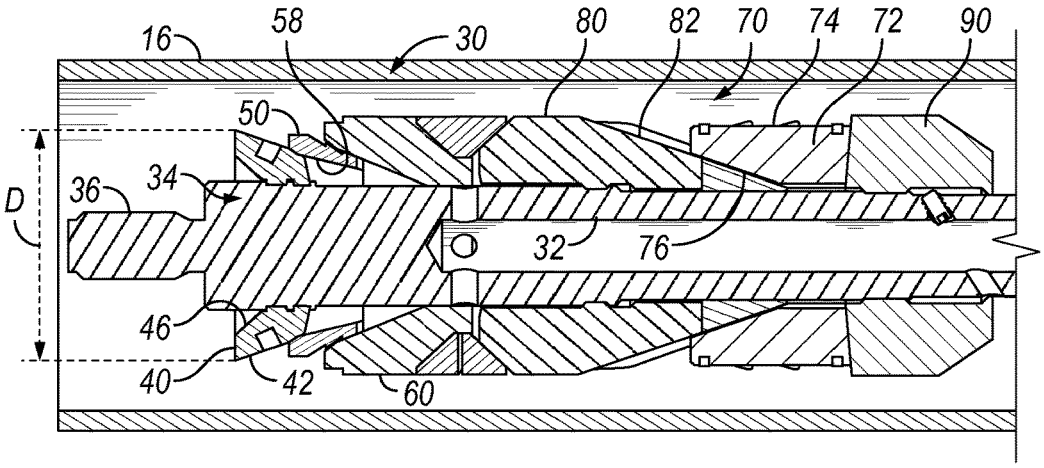
FIG. 3 is a sectional side view of the well tool of FIG. 2 in the RIH condition within the casing.

FIG. 3 is a sectional side view of the well tool 30 of FIG. 2 in the RIH condition within the casing 16. A connection end 36 is provided on the upper end of the well tool 30 for connecting to the setting tool of FIG. 1, which is omitted from view in FIG. 3 for ease of illustration. The well tool 30 has a central flow passage 34 through the well tool 30. The mandrel 32 is initially received in the central flow passage 34 and may be subsequently removed after setting. In another embodiment, a hollow mandrel could instead be used that remains in place and allows for fluid flow therethrough. When the mandrel 32 is removed, the central flow passage 34 of the well tool 30 will allow internal fluid communication along a longitudinal axis of the well tool 30. The seal seat 40 defines the axial flow bore 44, which may comprise an upper end of the central flow passage 34 through the well tool 30. Thus, the flow bore 44 of the seal seat 40 is in fluid communication with the wellbore. The seal seat 40 defines a sealing profile 46 at an upper end for receiving a loose sealing element (see FIG. 10), such as a ball or dart, to selectively close the axial flow bore 44 and thus close flow to the central flow passage 34 of the well tool 30.

The seal seat extender 50 has an inner profile 58 that conforms to the tapered outer profile 42 of the seal seat 40 for sliding engagement between the inner profile 58 of the seal seat extender 50 and the tapered outer profile 42 of the seal seat 40 when setting. The seal seat extender 50 radially expands as it moves along the tapered outer profile 42 of the seal seat 40. The seal seat 40 is actuatable toward the sealing element 60 in response to a setting force to deform the annular packing element 60 outwardly along the seal seat extender 50 into engagement with the wellbore defined here by the casing 16. In this example, the seal seat 40 and seal seat extender 50 have about the same diameter "D" in the RIH condition shown.

The diameter of the seal seat extender 50 is preferably less than or equal to the outer diameter of the seal seat 40 (subject to typical manufacturing tolerances) in the RIH condition, so that including the seal seat extender 50 does not appreciably increase an overall run-in diameter of the well tool 30. And yet, including the seal seat extender 50 may allow for greater radial/diametrical expansion of the packing element 60, which means the seal seat extender 50 may be used to extend the radial expansion that might otherwise be provided by a seal seat with no seal seat extender. The seal seat extender may effectively increase the outer diameter (OD) of the seal seat when set. For example, the effective OD may be increased by up to 44% or more as compared to the OD of a conventional plug with one seal seat. For example, in an example, the use of a seal seat extender with a well tool according to this disclosure may effectively seal an annulus between the tool and wellbore having a diametrical difference between the well tool outer diameter (OD) and casing ID of greater than 0.50 inch (~13 mm).

An anchoring system 70 is included with the well tool 30 to secure the well tool 30 downhole. The components of the wellbore tool 30 including the seal seat 40, seal seat extender 50, annular packing element 60, and anchoring system 70 are all concentrically disposed on the mandrel 32. The anchoring system 70 includes one or more slip 72 and one or more wedge 80 axially engageable with the slip 72 in response to the setting force to urge the slip 72 into radial engagement with the wellbore 16 to lock the sealing tool 30 within the casing 16. More particularly, the slip 72 includes an outer profile 74 for engaging the casing 16, and an inwardly facing taper 76 for slidingly engaging an outwardly facing taper 82 of the wedge 80. Thus, the same axial setting force provided by a setting tool to seal the annular packing element 60 into sealing engagement with the casing 16 may also be used to anchor the well tool 30 within the casing 16 using the anchoring system 70. The lower end of the well tool 30 includes a mule shoe 90 that protects the well tool 30 as it is run in hole. It also allows the plug to pass through other tools, casing joints, or anything with an upset that may otherwise cause the plug to get stuck.

Figure 4:
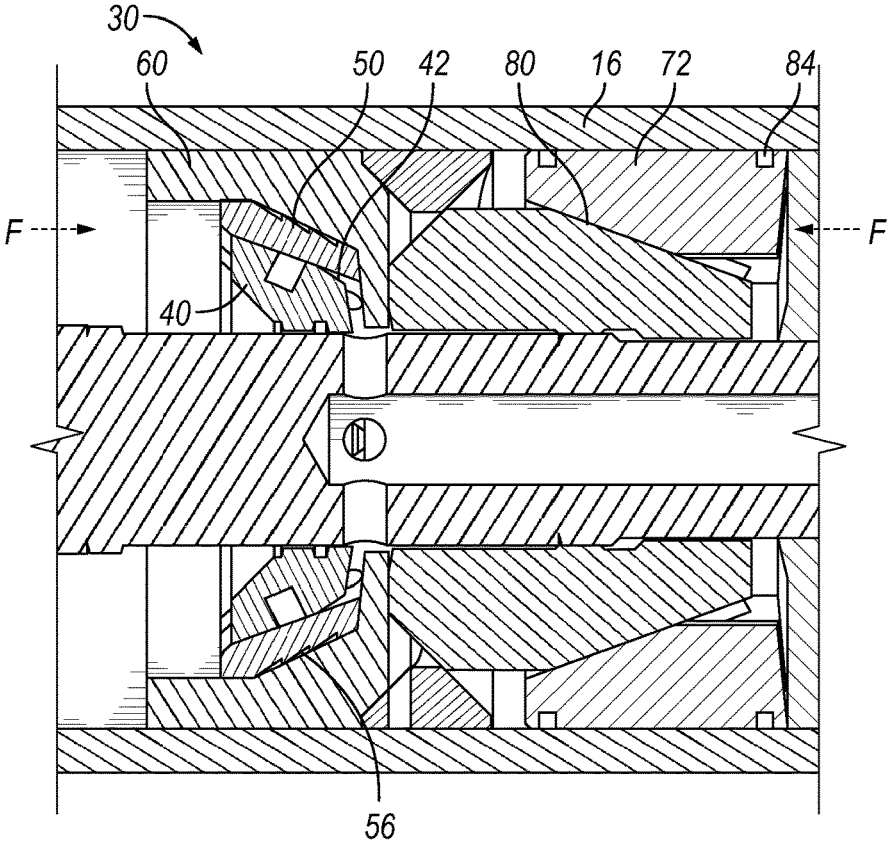
FIG. 4 is a sectional view of the well tool as set in the casing.

FIG. 4 is a sectional view of the well tool 30 as set in the casing 16. The set condition may be achieved in response to an axial setting force F applied by a setting tool to urge the seal seat 40, seal seat extender 50, annular packing element 60, and anchoring system together. The seal seat extender 50 has been radially expanded by sliding along the tapered outer profile 42 of the seal seat 40 by relative movement therebetween. The seal seat extender 50 is now at the same axial position but a greater diameter than the seal seat 40. The annular packing element 60 has been deformed radially outwardly along the outer tapered outer profile 56 of the seal seat extender 50 into sealing engagement with the ID of the casing 16. The packing element 60 is deformed into a volume that may be bounded, at least in part, by the ID of the casing 16, the extension limiter 66, an upper end of the wedge 80, and the tapered outer profile 56 of the seal seat extender 50.

Also in response to the setting force F, the slip 72 has been urged radially outwardly by the wedge 80 into locking engagement with the ID of the casing 16 to anchor the well tool 30 in place within the casing 16. A plurality of hardened inserts 84 arranged on the outer profile 74 of the slip 72 may be significantly harder than the material (e.g., steel) of the casing 16 to facilitate a biting engagement between the inserts 84 and the casing 16 to better anchor the well tool 30.

Figure 5:
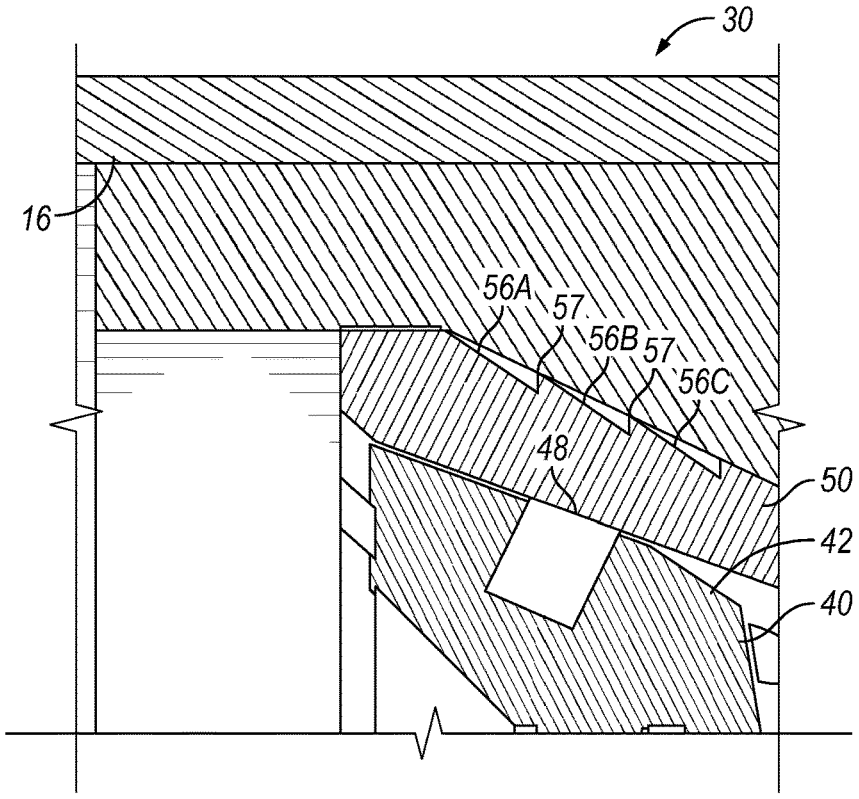
FIG. 5 is an enlarged view of the well tool in the set condition focusing on the seal seat and seal seat extender.

FIG. 5 is an enlarged view of the well tool in the set condition focusing on the seal seat 40 and seal seat extender 50. The plurality of frustoconical sections 56A, 56B, 56C appear as teeth 57 in the cross-section, for biting into the annular packing element 60. The frustoconical sections 56A, 56B, 56C in this configuration are functionally barbs that are directionally oriented axially upwardly (uphole). With this barbed orientation, the annular packing element 60 may more easily ride up the tapered outer profile 56 of the seal seat extender 50 during setting to deform the packing element 60 into engagement with the casing 16. After setting, the directional teeth 57 defined by the frustoconical sections 56A, 56B, 56C will then tend to bite into the annular packing element 60 to resist axial separation of the packing element 60 in the opposite direction from when setting. In this configuration, one or more hardened inserts 48 are disposed on the outer profile of the seal seat 40 to facilitate biting engagement between the inserts 48 and the seal seat extender 50 to help lock the seal seat 40 and seal seat extender 50 in position after setting the well tool 30. The insert(s) 48 may have an edge that protrudes slightly beyond the tapered outer profile 42 of the seal seat 40 to help bite into a relatively softer material (e.g, steel) of the seal seat extender 50.

Figure 6:
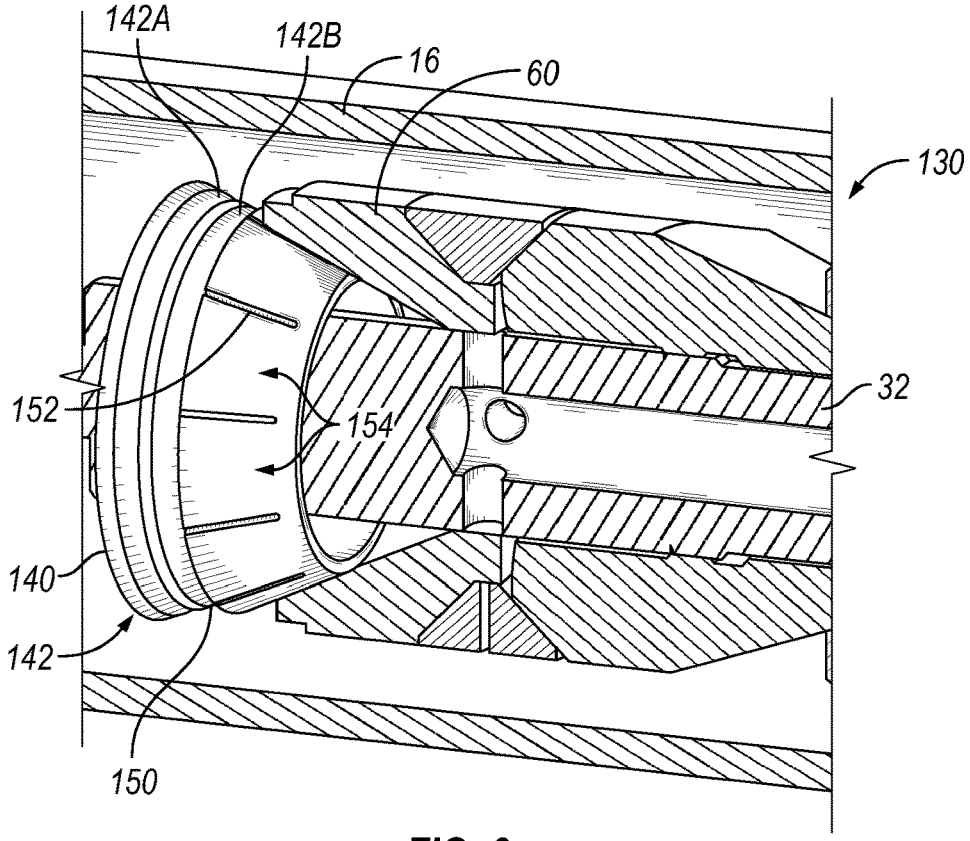
FIG. 6 is a perspective view of a well tool according to another example configuration.

FIG. 6 is a perspective view of a well tool 130 according to another example configuration. As in the preceding configuration, the well tool 130 is disposed in the casing 16, which defines an inner surface of the wellbore to be sealed. The well tool 130 is shown in a RIH condition, with a seal seat 140 and seal seat extender 150 axially arranged on the mandrel 32 with the compliant annular packing element 60. The seal seat 140, seal seat extender 150, and annular packing element 60 will be squeezed together axially with a setting tool to deform the annular packing element 60 outwardly along the seal seat extender 150 into engagement with the casing 16. The seal seat extender 150 is a unitary structure that includes expansion slots 152 between circumferentially spaced, structurally-interconnected sections 154 along its periphery, to facilitate this expansion (and could alternatively be structurally separate sections). As with the preceding configuration, the seal seat extender 150 increases the radial expansion of the packing element 60. However, the seal seat 140 and seal seat extender 150 have a different configuration in some respects than their counterpart components of the preceding configuration.

Figure 7:
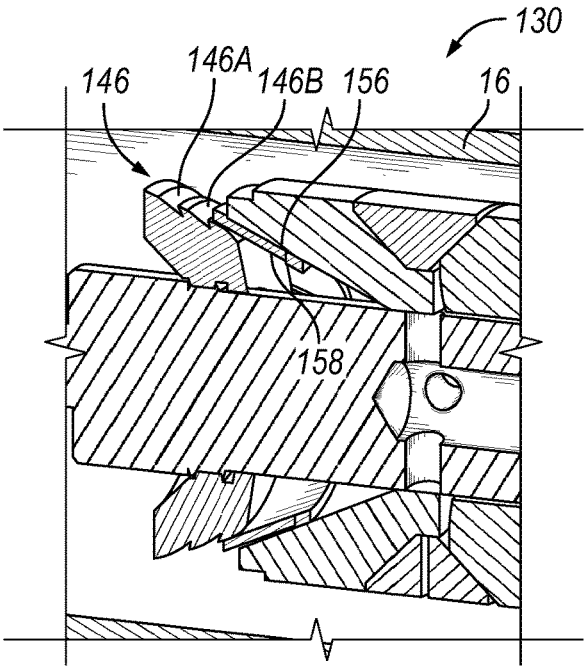
FIG. 7 is a cross-section of the well tool further detailing various features of the well tool of FIG. 6.

FIG. 7 is a cross-section of the well tool 130 further detailing various features of the well tool 130 of FIG. 6. The seal seat extender 150 is between the seal seat 140 and the packing element 60 and is expandable radially outwardly along the tapered outer profile 142 of the seal seat 140. However, the outer profile 142 of the seal seat 140 (rather than the seal seat extender) now includes a plurality of frustoconical sections 142A, 142B. The seal seat extender 150 instead has a smooth tapered outer profile 156 and a smooth tapered inner profile 158, both of which are generally frustoconical. When set, the seal seat extender 150 will again radially expand as it slides along the tapered outer profile 142 of the seal seat 140, and the annular packing element 60 will be deformed outwardly into sealing engagement with the casing 16. The anchoring system may be provided and function as in other embodiments to anchor the well tool 130 within the casing 16.

Figure 8:
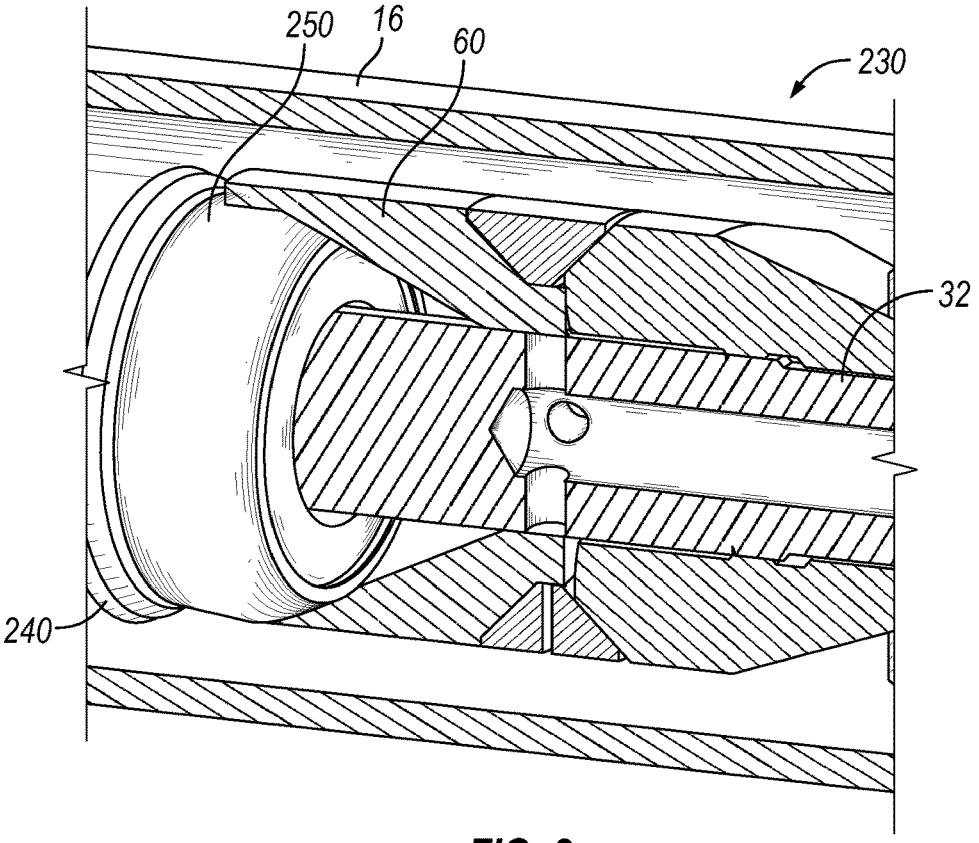
FIG. 8 is a perspective view of a well tool according to another example configuration.

FIG. 8 is a perspective view of a well tool 230 according to another example configuration. As in the preceding configurations, the well tool 230 is shown disposed in the casing 16, which defines an inner surface of the wellbore to be sealed. The well tool 230 is shown in a RIH condition, with a seal seat 240 and a seal seat extender 250 axially arranged on the mandrel 32 with the compliant annular packing element 60. The seal seat 240, seal seat extender 250, and annular packing element 60 will be squeezed together axially with a setting tool to deform the annular packing element 60 outwardly along the seal seat extender 250 into engagement with the casing 16. As with the preceding configuration, the seal seat extender 250 increases the radial expansion of the packing element 60. However, the seal seat 240 and seal seat extender 250 have a different configuration in some respects than their counterpart components of the preceding configurations. For example, the seal seat extender 250 is a unitary structure, and does not require the expansion slots or separate sections of the preceding configurations. Instead, to facilitate this expansion, the seal seat extender 250 has an annular profile that is configured to remain intact yet buckle outwardly in response to the setting force to help urge the annular packing element 60 outwardly into engagement with the casing 16.

Figure 9:
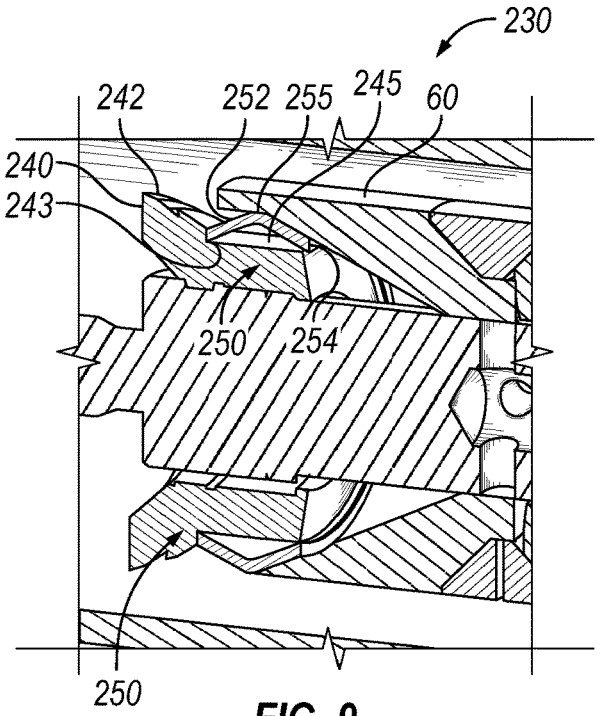
FIG. 9 is a cross-sectional view of the well tool of FIG. 8.

FIG. 9 is a cross-sectional view of the well tool 230 of FIG. 8. Rather than the entire seal seat extender sliding along the tapered outer profile of a seal seat during expansion as in the foregoing embodiments, an upper axial end 252 of this seal seat extender 250 is instead retained by a stop 243 on the seal seat 240. The seal seat 240 includes an elongated straight section 245, which may be generally cylindrical, that allows a lower axial end 254 of the seal seat extender 250 to slide or otherwise move axially upward relative to the upper axial end 252 as a central section 255 buckles further radially outwardly. To facilitate buckling, the seal seat extender 250 is pre-formed with an initial bend wherein the central section 255 sticks out radially. As the setting force is applied, the seal seat extender 250 will be compressed axially and the central section 255 buckles outwardly. This buckling may facilitate setting of the annular packing element 60 in one or more ways. Depending on the dimensions, the central section 255 may stick out significantly beyond the seal seat 240 upon buckling. Additionally, the buckling of the seal seat extender 250 may expand to partially fill an annular volume otherwise occupied by the annular packing element 60 so that the packing element 60 is squeezed to a greater extent.

A portion of the seal seat 240 also includes a tapered outer profile 242 axially above and extending radially outwardly of the cylindrical central section 255. The tapered outer profile 242 may include a plurality of frustoconical sections. When set, a portion of the annular packing element 60, rather than the seal seat extender, may slide up over the tapered outer profile 242, to further deform the annular packing element 60 outwardly into sealing engagement with the casing 16.

Figure 10:
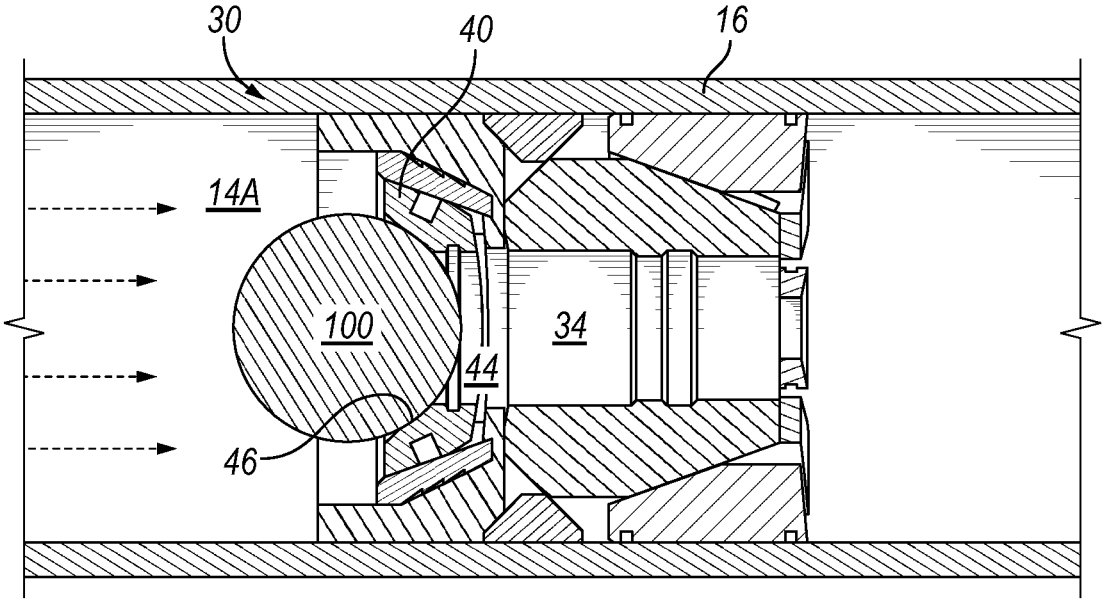
FIG. 10 is a sectional view of the well tool of FIG. 1 as used to perform a well service operation after it has been set within the casing.

FIG. 10 is a sectional view of the well tool 30 of FIG. 1 as used to perform a well service operation after it has been set within the casing 16. The well tool 30 in this example is embodied a frac plug used to plug the wellbore 14 prior to performing a hydraulic fracturing operation in the uphole portion 14A. A loose sealing element is embodied here as a loose ball 100, although a dart or other loose sealing element may alternatively be used if it is capable of sealing on a corresponding sealing profile of the seal seat. The seal seat 40 defines an axial flow bore 44, which may be an upper portion of the central flow passage 34 of the well tool 30, in fluid communication with the wellbore. The sealing profile 46 is positioned for receiving the ball 100 to close the axial flow bore 44. The ball 100 or other sealing element may be released from above, such as dropped from a surface of the well site or from some intermediate location. The ball 100 travels down the casing 16 and lands on the seal seat 40. Fluid pressure may then be applied from above in a service operation, which in the example of a hydraulic fracturing operation may be a proppant-laden frac fluid. The fluid pressure may urge the ball 100 into engagement with the seal sealing profile 46 and may increase the sealing engagement provided therebetween so that the frac plug can withstand the pressure required for hydraulic fracturing. Although depicted here as a frac plug, the well tool may be configured and used for a variety of purposes, including but not limited to bridge plugs, packers, and other suitable tools, to seal a wellbore in order to perform a service operation that requires such wellbore sealing.

Accordingly, the present disclosure may provide a high-expansion well sealing tool having a seal seat and seal seat extender to facilitate and/or increase expansion of an annular packing element. The methods/systems/compositions/tools may include any of the various features disclosed herein, including one or more of the following statements.

Statement 1. A high-expansion sealing tool for sealing a wellbore, comprising: a seal seat having an axial flow bore in fluid communication with the wellbore, a sealing profile for receiving a loose sealing element to close the axial flow bore, and a tapered outer profile; a seal seat extender disposed against the seal seat, the seal seat extender expandable against the seal seat in response to an axial setting force; and a compliant annular packing element disposed against the seal seat extender, the annular packing element deformable outwardly into sealing engagement with the wellbore in response to the axial setting force.

Statement 2. The high-expansion sealing tool of Statement 1, wherein the seal seat extender comprises a tapered inner profile for sliding engagement with the tapered outer profile of the seal seat to expand the seal seat extender against the seal seat in response to the axial setting force.

Statement 3. The high-expansion sealing tool of Statement 2, wherein the seal seat comprises a plurality of outwardly facing teeth for engaging the tapered inner profile of the seal seat extender.

Statement 4. The high-expansion sealing tool of Statement 3, wherein the seal seat comprises one or more hardened inserts disposed along the tapered outer profile for engaging the tapered inner profile of the seal seat extender.

Statement 5. The high-expansion sealing tool of any of Statements 1 to 4, wherein the seal seat extender comprises an external profile with a plurality of outwardly facing teeth for engaging the annular packing element.

Statement 6. The high-expansion sealing tool of any of Statements 1 to 5, wherein the seal seat extender has a run-in outer diameter of less than or equal to an outer diameter of the seal seat, and expands against the seal seat to a set diameter greater than the outer diameter of the seal seat.

Statement 7. The high-expansion sealing tool of any of Statements 1 to 6, wherein the seal seat extender comprises an annular profile configured to buckle outwardly in response to the setting force to urge the annular packing element outwardly into engagement with the wellbore.

Statement 8. The high-expansion sealing tool of any of Statements 1 to 7, wherein the loose sealing element comprises a ball or dart configured to seal against the sealing profile with sufficient pressure for a hydraulic fracturing operation.

Statement 9. The high-expansion sealing tool of any of Statements 1 to 8, further comprising: an anchoring system adjacent to the annular packing element comprising a slip and a wedge axially engageable with the slip in response to the setting force to urge the slip into radial engagement with the wellbore to lock the sealing tool within the wellbore.

Statement 10. The high-expansion sealing tool of Statement 9, wherein the seal seat, seal seat extender, annular packing element, and anchoring system are concentrically positionable on a mandrel for positioning inside the wellbore, and wherein the mandrel is removable after urging the annular packing element and slip into engagement with the wellbore.

Statement 11. A high-expansion sealing system, comprising: a well tool disposable in a wellbore, including a mandrel, a seal seat disposed on the mandrel and defining an axial flow bore, a sealing profile about the axial flow bore for receiving a loose sealing element to close the axial flow bore, and a tapered outer profile; an elastically deformable annular packing element disposed on the mandrel axially spaced from the seal seat; a seal seat extender disposed on the mandrel between the seal seat and the annular packing element, wherein the seal seat extender is expandable in response to an axial setting force; and a setting tool configured for applying the axial setting force to the seal seat, annular packing element, and seal seat extender to expand the seal seat extender and to deform the annular packing element outwardly along the seal seat extender into engagement with the wellbore.

Statement 12. The high-expansion sealing system of Statement 11, further comprising: an anchoring system adjacent to the annular packing element and comprising a slip and a wedge axially engageable with the slip by the setting tool to urge the slip into locking engagement with the wellbore.

Statement 13. The high-expansion sealing system of Statement 12, wherein, with the mandrel subsequently removed, the locking engagement provided by the setting tool axially secures the well tool in the wellbore and an engagement between the seal seat, seal seat extender, and annular packing element maintain sealing engagement of the annular packing element with the wellbore.

Statement 14. The high-expansion sealing system of Statement 11 or 12, wherein the loose sealing element comprises a drop ball or a dart.

Statement 15. A method of servicing a wellbore, comprising: disposing a well tool comprising a seal seat, a seal seat extender, and an annular packing element into the wellbore on a mandrel, with the seal seat extender disposed between the seal seat and annular packing element; and applying an axial setting force to urge the seal seat and the annular packing element toward one another, to expand the seal seat extender against the seal seat and to deform the annular packing element radially outwardly with the seal seat extender into engagement with the wellbore.

Statement 16. The method of Statement 15, wherein expanding the seal seat extender against the seal seat comprises sliding the seal extender outwardly along a tapered outer profile of the seal seat in response to the axial setting force.

Statement 17. The method of Statement 15 or 16, wherein expanding the seal seat extender against the seal seat comprises buckling the seal seat extender outwardly in response to the setting force to urge the annular packing element outwardly into engagement with the wellbore.

Statement 18. The method of any of Statements 1 to 17, further comprising: dropping a loose sealing element into the wellbore onto the seal seat to close an axial flow bore through the seal seat; and performing a well service comprising applying a pressurized fluid to the wellbore above the seal seat, wherein the seal seat prevent flow of the pressurized fluid through the axial flow bore and wherein the annular packing element prevent flow of the pressurized fluid around the seal seat.

Statement 19. The method of Statement 18, wherein the well service comprises a hydraulic fracturing operation in the wellbore above the well tool, wherein the well tool comprises a hydraulic fracturing plug, and wherein the pressurized fluid comprises a hydraulic fracturing fluid.

Statement 20. The method of any of Statements 1 to 19, further comprising removing the mandrel after urging the annular packing element and slip into engagement with the wellbore.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A high-expansion sealing tool for sealing a wellbore, comprising:

a seal seat having an axial flow bore in fluid communication with the wellbore, a sealing profile for receiving a loose sealing element to close the axial flow bore, and a tapered outer profile;

a seal seat extender disposed against the seal seat, the seal seat extender expandable adjacent the seal seat in response to an axial setting force;

a compliant annular packing element disposed against the seal seat extender, the annular packing element deformable outwardly into sealing engagement with the wellbore in response to the axial setting force; and wherein the seal seat extender comprises an annular profile configured to buckle outwardly in response to the setting force to urge the annular packing element outwardly into engagement with the wellbore.

2. The high-expansion sealing tool of claim 1, wherein the seal seat extender comprises a tapered inner profile for sliding engagement with the tapered outer profile of the seal seat to expand the seal seat extender against the seal seat in response to the axial setting force.

3. The high-expansion sealing tool of claim 2, wherein the seal seat comprises a plurality of outwardly facing teeth for engaging the tapered inner profile of the seal seat extender.

4. The high-expansion sealing tool of claim 3, wherein the seal seat comprises one or more hardened inserts disposed along the tapered outer profile for engaging the tapered inner profile of the seal seat extender.

5. The high-expansion sealing tool of claim 1, wherein the seal seat extender comprises an external profile with a plurality of outwardly facing teeth for engaging the annular packing element.

6. The high-expansion sealing tool of claim 1, wherein the seal seat extender has a run-in outer diameter of less than or equal to an outer diameter of the seal seat, and expands against the seal seat to a set diameter greater than the outer diameter of the seal seat.

7. The high-expansion sealing tool of claim 1, wherein the loose sealing element comprises a ball or dart configured to seal against the sealing profile in response to fluid pressure applied from above.

8. The high-expansion sealing tool of claim 1, further comprising:

an anchoring system adjacent to the annular packing element comprising a slip and a wedge axially engageable with the slip in response to the setting force to urge the slip into radial engagement with the wellbore to lock the sealing tool within the wellbore.

9. The high-expansion sealing tool of claim 8, wherein the seal seat, seal seat extender, annular packing element, and anchoring system are concentrically positionable on a mandrel for positioning inside the wellbore, and wherein the mandrel is removable after urging the annular packing element and slip into engagement with the wellbore.

10. A high-expansion sealing system, comprising:

a well tool disposable in a wellbore, including a mandrel, a seal seat disposed on the mandrel and defining an axial flow bore in fluid communication with the wellbore, a sealing profile about the axial flow bore for receiving a loose sealing element to close the axial flow bore, and a tapered outer profile;

a seal seat extender disposed against the seal seat, the seal seat extender expandable adjacent the seal seat in response to an axial setting force;

a compliant annular packing element disposed against the seal seat extender, the annular packing element deformable outwardly into sealing engagement with the wellbore in response to the axial setting force;

wherein the seal seat extender comprises an annular profile configured to buckle outwardly in response to the setting force to urge the annular packing element outwardly into engagement with the wellbore; and a setting tool configured for applying the axial setting force.

11. The high-expansion sealing system of claim 10, further comprising:

an anchoring system adjacent to the annular packing element and comprising a slip and a wedge axially engageable with the slip by the setting tool to urge the slip into locking engagement with the wellbore.

12. The high-expansion sealing system of claim 11, wherein, with the mandrel subsequently removed, the locking engagement provided by the setting tool axially secures the well tool in the wellbore and an engagement between the seal seat, seal seat extender, and annular packing element maintain sealing engagement of the annular packing element with the wellbore.

13. The high-expansion sealing system of claim 10, wherein the loose sealing element comprises a drop ball or a dart.

14. A method of servicing a wellbore, comprising:

disposing a well tool comprising a seal seat, a seal seat extender, and an annular packing element into the wellbore on a mandrel, with the seal seat extender disposed between the seal seat and annular packing element; and applying an axial setting force to urge the seal seat and the annular packing element toward one another, to expand the seal seat extender against the seal seat and to deform the annular packing element radially outwardly with the seal seat extender into engagement with the wellbore;

wherein expanding the seal seat extender against the seal seat comprises buckling the seal seat extender outwardly in response to the setting force to urge the annular packing element outwardly into engagement with the wellbore.

15. The method of claim 14, wherein expanding the seal seat extender against the seal seat comprises sliding the seal extender outwardly along a tapered outer profile of the seal seat in response to the axial setting force.

16. The method of claim 14, further comprising:

dropping a loose sealing element into the wellbore onto the seal seat to close an axial flow bore through the seal seat; and performing a well service comprising applying a pressurized fluid to the wellbore above the seal seat, wherein the seal seat prevent flow of the pressurized fluid through the axial flow bore and wherein the annular packing element prevent flow of the pressurized fluid around the seal seat.

17. The method of claim 16, wherein the well service comprises a hydraulic fracturing operation in the wellbore above the well tool, wherein the well tool comprises a hydraulic fracturing plug, and wherein the pressurized fluid comprises a hydraulic fracturing fluid.

18. The method of claim 14, further comprising removing the mandrel after urging the annular packing element and slip into engagement with the wellbore.

* * * * *